US008181585B1

(12) United States Patent
Samilo et al.

(10) Patent No.: US 8,181,585 B1
(45) Date of Patent: May 22, 2012

(54) APPARATUS AND METHOD FOR COMPRESSED AIR SYSTEM

(75) Inventors: John Samilo, Ringgold, GA (US); Chris Smith, Chickamauga, GA (US)

(73) Assignee: CYP Technologies, LLC, Chattanooga, TN (US)

( * ) Notice: Subject to any disclaimer, the term of this patent is extended or adjusted under 35 U.S.C. 154(b) by 400 days.

(21) Appl. No.: 12/459,004

(22) Filed: Jun. 26, 2009

Related U.S. Application Data

(60) Provisional application No. 61/133,290, filed on Jun. 27, 2008.

(51) Int. Cl.
*D05C 15/00* (2006.01)

(52) U.S. Cl. ..... 112/80.01

(58) Field of Classification Search ..... 112/98, 112/103, 470.09, 220, 221, 80.5, 80.01, 80.08, 112/2.2, 7
See application file for complete search history.

(56) References Cited

U.S. PATENT DOCUMENTS

| | | | | | |
|---|---|---|---|---|---|
| 3,595,185 | A | * | 7/1971 | Shorrock et al. | 112/80.08 |
| 3,937,157 | A | * | 2/1976 | Spanel et al. | 112/80.07 |
| 5,158,027 | A | * | 10/1992 | Ingram | 112/80.08 |
| 5,165,352 | A | * | 11/1992 | Ingram | 112/80.08 |
| 5,588,383 | A | * | 12/1996 | Davis et al. | 112/80.16 |
| 5,738,030 | A | * | 4/1998 | Ok | 112/475.23 |

* cited by examiner

*Primary Examiner* — Tejash Patel
(74) *Attorney, Agent, or Firm* — Chambliss, Bahner & Stophel, P.C.

(57) ABSTRACT

A compressed air system adapted for use in connection with a tufting machine having a yarn applicator adapted to penetrate a backing of a surface covering and place a stitch in the backing of the surface covering, a presser foot and a funnel block. The compressed air system comprises an air source adapted to provide air to the compressed air system, a digital presser foot injector adapted to convey compressed air to the presser foot, and a funnel block injector adapted to convey compressed air to the funnel block. The compressed air system is adapted to convey compressed air to the digital presser foot injector and the funnel block injector only when the yarn applicator is in use. The method comprises conveying air to the presser foot only when the yarn applicator is in use, and conveying air to the funnel block only when the yarn applicator is in use.

20 Claims, 9 Drawing Sheets

FIGURE 8
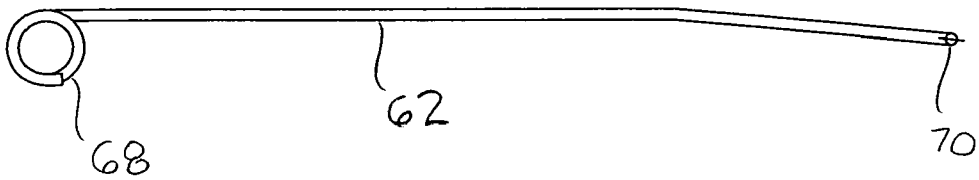
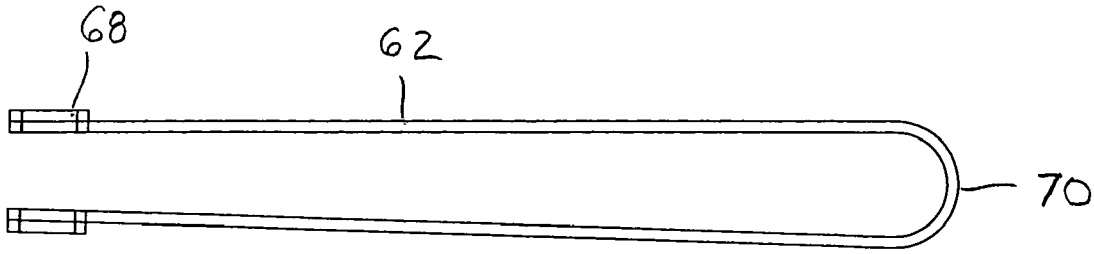
FIGURE 8A

APPARATUS AND METHOD FOR COMPRESSED AIR SYSTEM

RELATED PATENTS AND APPLICATIONS

This application relates back to and claims the benefit of priority from U.S. Provisional Application for Patent No. 61/133,290 titled Apparatus and Method for Compressed Air System filed on Jun. 27, 2008.

FIELD OF THE INVENTION

The present invention relates generally to systems adapted to produce and convey compressed air or gases, and particularly to compressed air systems on tufting machines.

BACKGROUND AND DESCRIPTION OF THE PRIOR ART

It is known to provide tufting machines with compressed air systems. However, conventional compressed air systems on tufting machines suffer from one or more disadvantages. For example, conventional compressed air systems on tufting machines use an excessive amount of compressed air. As a result, conventional compressed air systems on tufting machines are expensive to operate.

It would be desirable, therefore, if an apparatus and method could be provided that would reduce the amount of compressed air required to operate a tufting machine. It would also be desirable if such an apparatus and method would reduce the cost of operating a tufting machine.

ADVANTAGES OF THE PREFERRED EMBODIMENTS OF THE INVENTION

Accordingly, it is an advantage of the preferred embodiments of the invention described herein to provide an apparatus and method for a compressed air system on a tufting machine that reduces the amount of compressed air required to operate the tufting machine. It is also an advantage of the preferred embodiments of the invention to provide an apparatus and method for a compressed air system on a tufting machine that reduces the cost of operating the tufting machine.

Additional advantages of the preferred embodiments of the invention will become apparent from an examination of the drawings and the ensuing description.

EXPLANATION OF TECHNICAL TERMS

As used herein, the term "air" shall mean air, compressed air or any other gas(es) or compressed gas(es). The term "air" shall also include any combination of air, compressed air or other gas(es) or compressed gas(es).

As used herein, the term "surface covering" shall mean any type of apparatus, manufacture or composition of matter adapted to partially or entirely cover a surface such as a floor, a wall and the like. The term "surface covering" includes without limitation artificial turf, synthetic grass, carpeting, rugs, wall hangings and the like.

As used herein, the terms "stitch" and "yarn" shall mean any type of material that may be penetrated into and through the backing of a surface covering. The terms "stitch" and "yarn" include without limitation all materials used to produce artificial turf; synthetic grass, carpeting, rugs, wall hangings and the like.

SUMMARY OF THE INVENTION

The apparatus of the invention comprises a compressed air system adapted for use in connection with a tufting machine having a yarn applicator adapted to penetrate a backing of a surface covering and place a stitch in the backing of the surface covering, a presser foot and a funnel block. The compressed air system comprises an air source adapted to provide air to the compressed air system, a digital presser foot injector adapted to convey compressed air to the presser foot, and a funnel block injector adapted to convey compressed air to the funnel block. The compressed air system is adapted to convey compressed air to the digital presser foot injector and the funnel block injector only when the yarn applicator is in use.

In a preferred embodiment of the apparatus of the invention, the compressed air system is adapted for use in a tufting machine having a plurality of yarn applicators each of which is adapted to penetrate a backing of a surface covering and place a stitch in the backing of the surface covering, a plurality of presser feet and a plurality of funnel blocks. The preferred compressed air system comprises an air source adapted to provide compressed air to the compressed air system, a plurality of digital presser foot injectors adapted to convey compressed air to one of the plurality of presser feet, and a plurality of funnel block injectors adapted to convey compressed air to one of the plurality of funnel blocks. The preferred compressed air system is adapted to convey compressed air to each of the plurality of presser feet only when the yarn applicator with which said presser foot is operatively connected is penetrating the backing of the surface covering, and wherein said compressed air system is adapted to convey compressed air to each of the plurality of funnel blocks only when the yarn applicator with which said funnel block is operatively connected is placing the stitch in the backing of the surface covering.

The invention also comprises a method for controlling compressed air in a tufting machine having a yarn applicator adapted to penetrate a backing of a surface covering, a presser foot and a funnel block. The method of the invention comprises providing a compressed air system. The compressed air system comprises an air source adapted to provide air to the compressed air system, a digital presser foot injector adapted to convey air to the presser foot, and a funnel block injector adapted to convey air to the funnel block. The compressed air system is adapted to convey air to the presser foot and the funnel block only when the yarn applicator is in use. The method also comprises conveying air to the presser foot only when the yarn applicator is in use, and conveying air to the funnel block only when the yarn applicator is in use.

In a preferred embodiment of the method of the invention, the method for controlling compressed air in a tufting machine further comprises conveying air to the presser foot only when the yarn applicator is penetrating the backing of the surface covering; and conveying air to the funnel block only when the yarn applicator is placing a stitch in the backing of the surface covering.

BRIEF DESCRIPTION OF THE DRAWINGS

The presently preferred embodiments of the invention are illustrated in the accompanying drawings, in which like reference numerals represent like parts throughout, and in which:

FIG. 8 is a left side view of the preferred stitch retractor assembly wire illustrated in FIGS. 5-7 in accordance with the present invention.

FIG. 8A a top view of the preferred stitch retractor assembly wire illustrated in FIGS. 5-8 in accordance with the present invention.

DESCRIPTION OF THE PREFERRED EMBODIMENTS OF THE INVENTION

Figure 1:
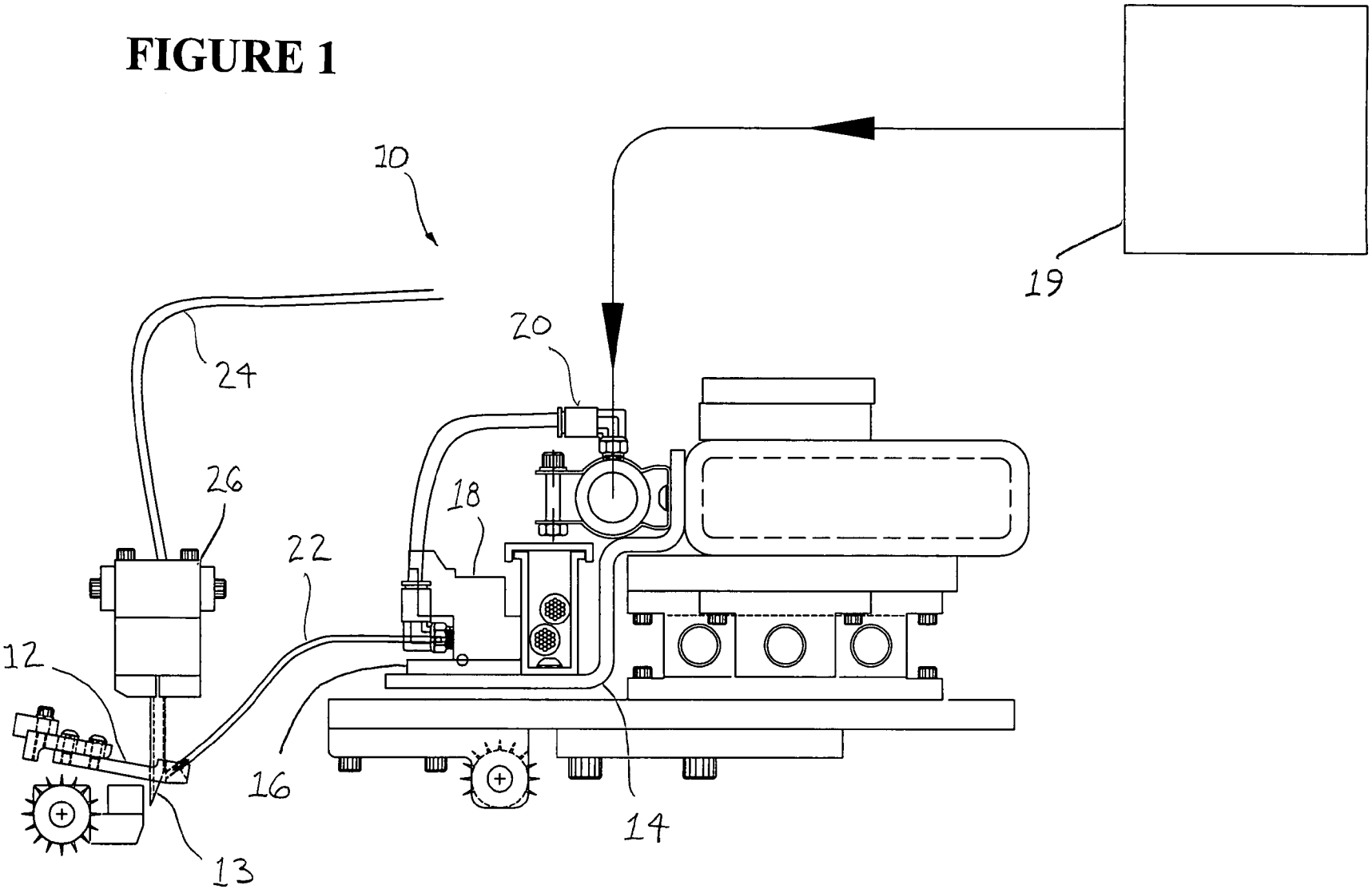
FIG. 1 is a left side view of the preferred digital presser foot injector in accordance with the present invention.

Referring now to the drawings, the preferred embodiments of the apparatus and method for a compressed air system are illustrated by FIGS. 1 through 9. As shown in FIGS. 1 through 9, the preferred compressed air system is adapted for use on a tufting machine that produces surface coverings. It is contemplated within the scope of the invention, however, that the preferred compressed air system may be adapted for use on other types of machinery and equipment.

Referring now to FIG. 1, a left side view of the preferred digital presser foot injector of the preferred compressed air system is illustrated. As shown in FIG. 1, the preferred digital presser foot injector is designated generally by reference numeral 10. The preferred digital presser foot injector 10 is adapted to convey air to presser foot 12 when yarn applicator 13 is penetrating the backing of a surface covering. By conveying compressed air to presser foot 12 only when yarn applicator 13 is penetrating the backing of a surface covering, the preferred compressed air system uses less compressed air than conventional compressed air systems and results in reduced operating costs compared to conventional systems. In most tufting machines, more than fifty percent (50%) of the total compressed air used by the machine is conveyed to the presser foot. The preferred digital presser foot injector has been found to result in a fourteen percent (14%) reduction in power consumption on a tufting machine.

The preferred digital presser foot injector 10 is mounted on mounting bracket 14 and mounting bar 16 and includes at least one solenoid valve 18. Preferably, a means for controlling the conveyance of compressed air such as solenoid valve 18 is provided. The preferred solenoid valve 18 is a two-way solenoid mounted between an air source and presser foot 12. It is contemplated within the scope of the invention, however, that any suitable valve or other device, mechanism, assembly or combination thereof adapted to control the conveyance of air or other gases may be used. It is also contemplated within the scope of the invention that any suitable air source such as compressor 19 and the like may be used to provide air to the system. Preferably, digital presser foot injector 10 conveys air to presser foot 12 via a means for conveying air such as air manifold 20 and presser foot line 22. It is contemplated within the scope of the invention, however, that the preferred digital presser foot injector may convey air to presser foot 12 via any suitable means including without limitation chambers, pipes, hoses, tubes, conduits and the like. In the preferred embodiments, funnel block line 24 extends from funnel block 26 to a funnel block injector (see FIG. 2).

Figure 2:
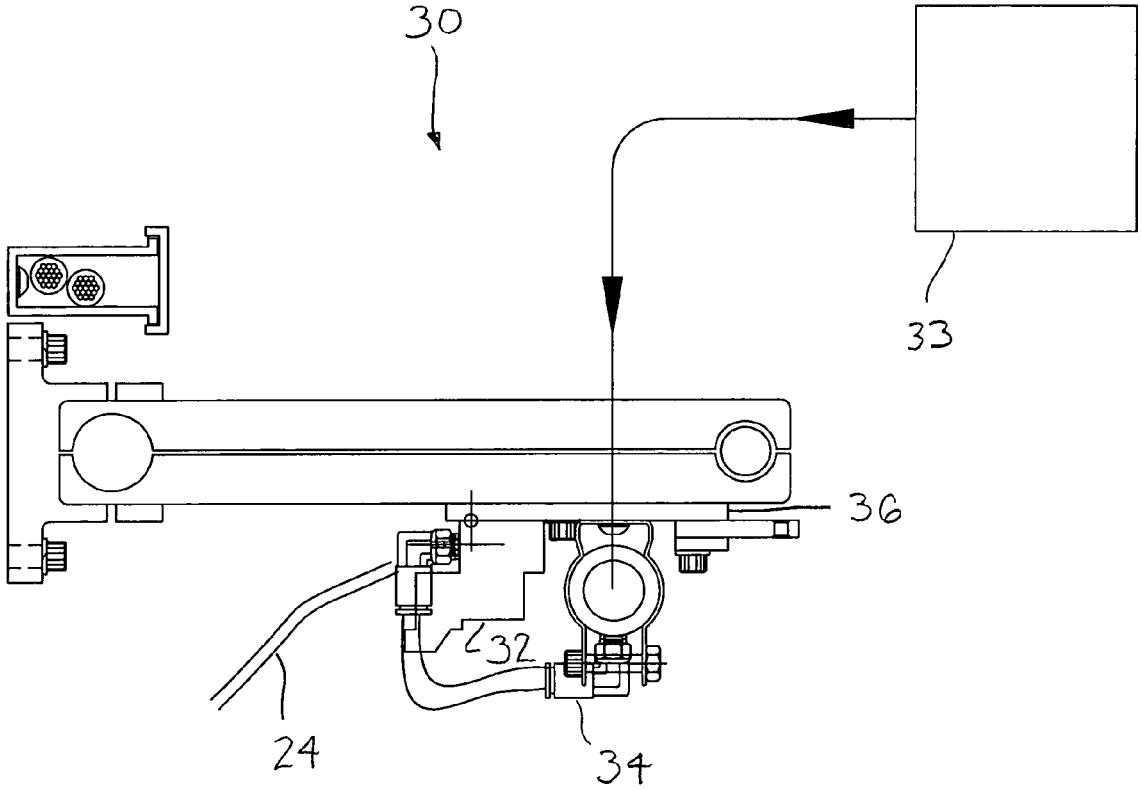
FIG. 2 is a left side view of the preferred funnel block injector in accordance with the present invention.

Referring now to FIG. 2, a left side view of the preferred funnel block injector of the preferred compressed air system is illustrated. As shown in FIG. 2, the preferred funnel block injector is designated generally by reference numeral 30. The preferred funnel block injector 30 is adapted to convey air to funnel block 26 while a stitch is being placed in the backing of a surface covering. By conveying air to funnel block 26 (see FIG. 1) only while a stitch is being placed in backing of a surface covering, the preferred compressed air system uses less compressed air than conventional compressed air systems and results in reduced operating costs compared to conventional systems. The preferred funnel block injector has been found to result in a sixteen percent (16%) reduction in power consumption on a tufting machine.

Still referring to FIG. 2, the preferred funnel block injector 30 includes a means for controlling the conveyance of compressed air to the funnel block such as solenoid valve 32. Preferably, solenoid valve 32 is a two-way solenoid mounted between an air source and funnel block 26 (see also FIG. 1). It is contemplated within the scope of the invention, however, that any suitable valve or other device, mechanism, assembly or combination thereof adapted to control the conveyance of air or other gases may be used. It is also contemplated within the scope of the invention that any suitable air source such as compressor 33 and the like may be used to provide air to the system. Preferably, the funnel block injector 30 includes a means for conveying compressed air from the air source to the funnel block such as air supply manifold 34 mounted on mounting bar 36 and funnel block line 24. The preferred air supply manifold 34 is in fluid communication with funnel block 26 via funnel block line 24 (see also FIG. 1). It is contemplated within the scope of the invention, however, that the preferred funnel block injector may convey air to funnel block 26 via any suitable means including without limitation chambers, pipes, hoses, tubes, conduits and the like.

Figure 3:
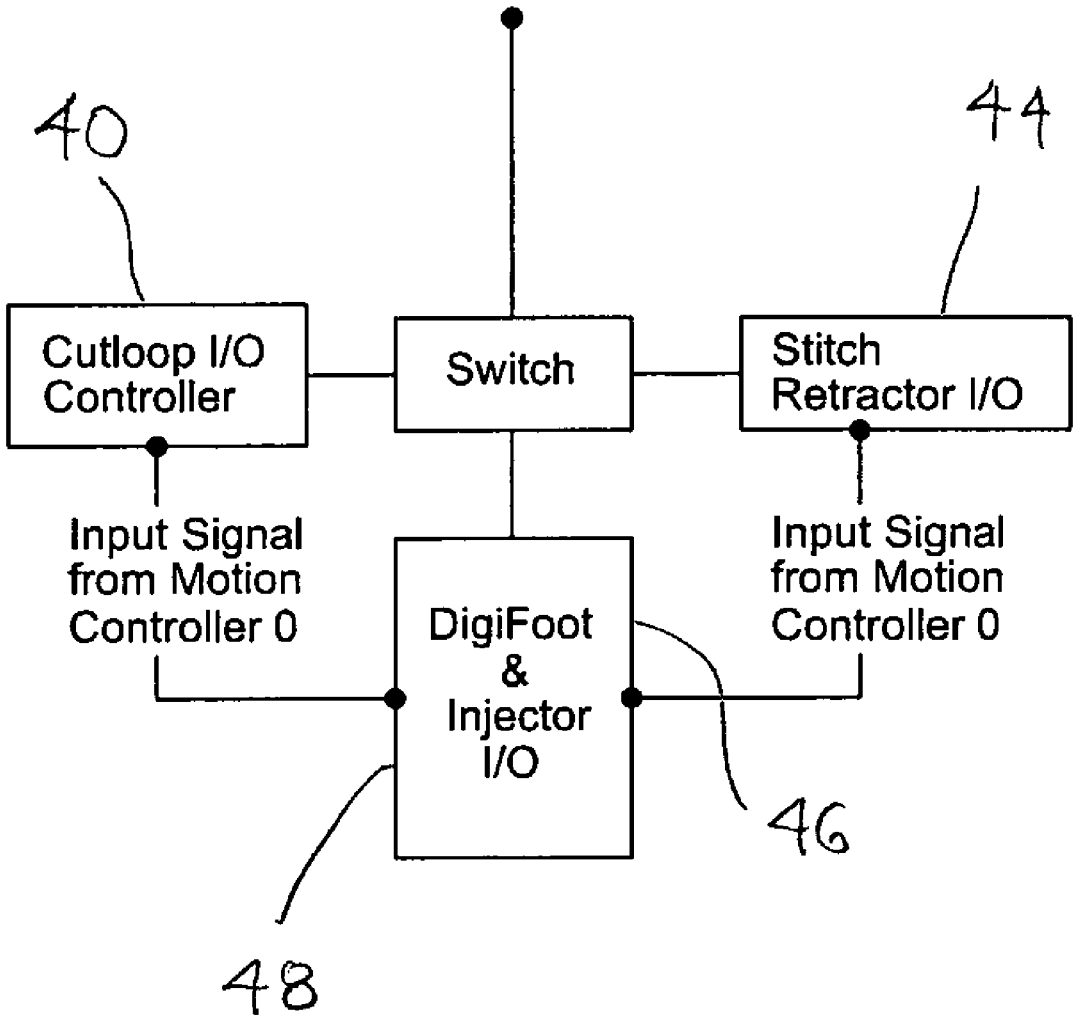
FIG. 3 is a schematic view of the preferred compressed air system in accordance with the present invention.

Referring now to FIG. 3, a schematic view of the preferred compressed air system is illustrated. The preferred compressed air system is adapted to control the conveyance of air by digital presser foot injector 10 and funnel block injector 30 (see FIGS. 1 and 2). As shown in FIG. 3, preferred compressed air system comprises the actual cut-loop I/O 40 and three other devices controlled by a cut-loop software program; namely, stitch retractor assembly I/O 44, digital presser foot injector I/O 46, and funnel block injector I/O 48. Preferably, the same type of digital I/O will control each of these devices. The preferred digital I/O has two parts. First, the preferred digital I/O includes an I/O CPU having code that is programmed to take data from the cut-loop software program and determine which cutting means (such as knives or blades) must be activated and when to activate them. Preferably, the data from the cut-loop software program includes a string of "1"s and "0"s which correspond to the number of needles on the tufting machine. Preferably, a "1" corresponds with on and a "0" corresponds with off. When the I/O CPU receives a signal from the motion controller, it activates the cutting means corresponding to the "1s" and turns off the cutting means corresponding to the "0"s.

Still referring to FIG. 3, the preferred assembly I/O 44 receives data from the cut-loop software program. This data preferably consist of "1"s and "0"s similar to the cut-loop I/O 40. Preferably, a "1" instructs the I/O to pull out the next stitch from the backing of the surface covering and a "0" instructs the I/O to do nothing. The output from the I/O is preferably connected to small digital solenoids that activate the stitch retractor assembly and pull the previous stitch from the face of the backing of the surface covering to the back of the backing of the surface covering. The preferred digital presser foot injector and the preferred funnel block injector share a single I/O system, as both of them preferably use the same set of data from the cut-loop software program. The preferred digital presser foot injector and the preferred funnel block injector are timed off of two individual input signals from a motion controller.

Figure 4:
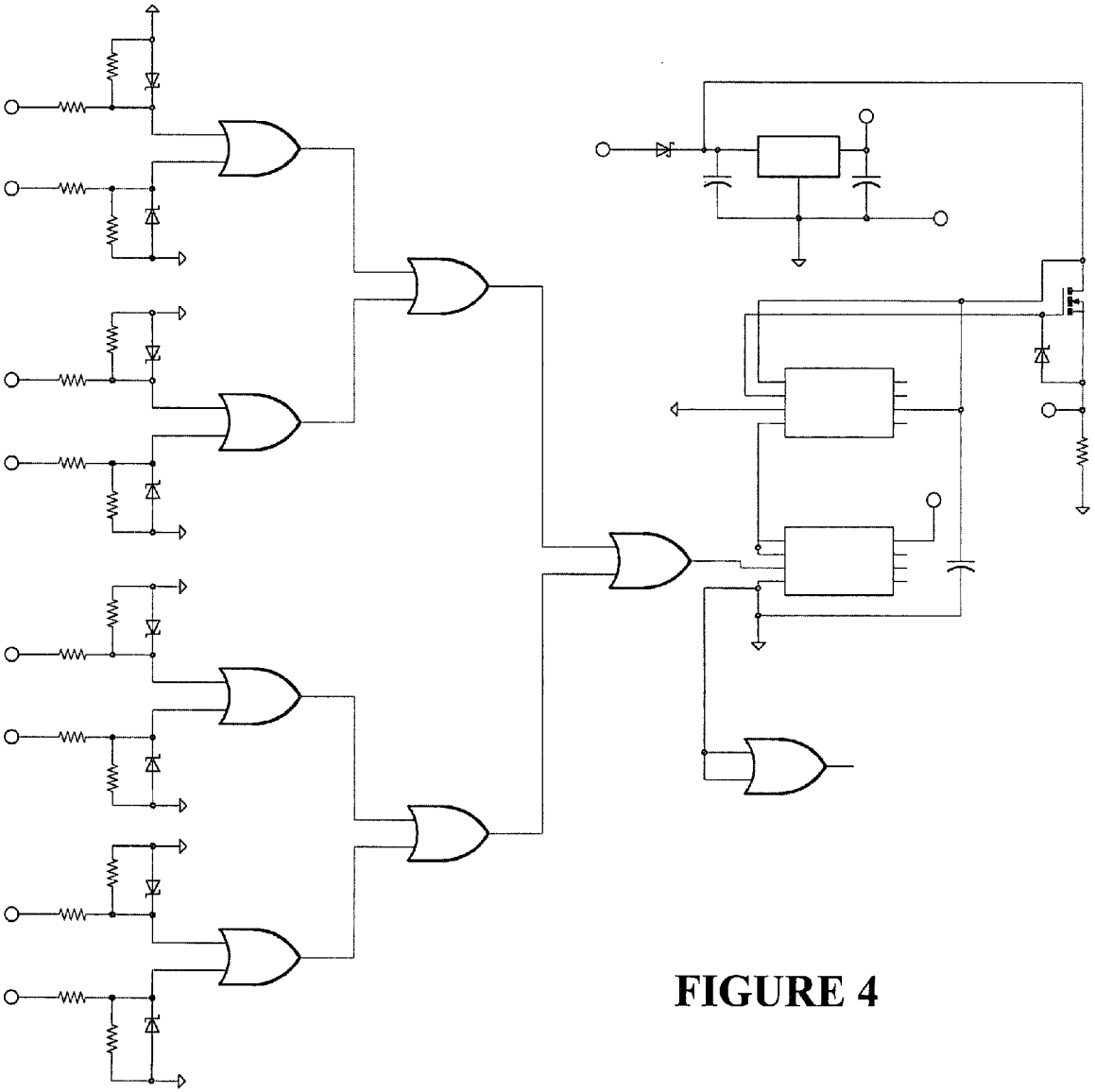
FIG. 4 is a schematic view of an alternative system for controlling the digital presser foot injector and the funnel block injector in accordance with the present invention.

Referring now to FIG. 4, a schematic view of an alternative system for controlling the digital presser foot injector and the funnel block injector is illustrated. As shown in FIG. 4, the digital presser foot injector and the funnel block injector may be controlled by a hardware solution such as an OR logic gate device. Preferably, all of the I/O points available to the colors of yarn for a needle (e.g., eight colors) are connected to an eight-point OR logic gate circuit. The output of the logic gate circuit is preferably connected to the appropriate solenoid valve that controls the digital presser foot injector and/or the digital funnel block injector for that needle. If any of the eight available I/O points are active, the output of the logic gate device would preferably make the solenoid available to be switched ON by the motion controller. While the preferred hardware solution is an OR logic gate device, it is contemplated within the scope of the invention that any suitable logic gate device or combination of logic gate devices may be used to control the digital presser foot injector and funnel block injector.

Preferably, the digital presser foot injector and the funnel block injector are designed to conserve compressed air during operation of the tufting machine. The preferred digital presser foot injector and the preferred funnel block injector function substantially identically, but each toggles a different air system at slightly different times. The preferred digital presser foot injector conveys air to the presser feet only while the needle is penetrating the backing of the surface covering. The preferred funnel block injector conveys injector air only while the stitch is being placed on the backing of the surface covering. In addition, the preferred digital presser foot injector and the preferred funnel block injector receive input data from the compressed air system. The preferred input data comprises "1"s and "0"s and permits the digital presser foot injector and the funnel block injector to determine which needles are actually in use so that air is conveyed to only those needles that are in use, e.g. placing a stitch in the backing of a surface covering. It is contemplated within the scope of the invention that the preferred compressed air system is adapted to operate within a remote process control computer system as described in the U.S. Patent Application of Samilo entitled Apparatus and Method for Multiple Yarn and Multiple Pile Height Tufting Machine and filed on Jun. 13, 2008, the entire disclosure of which is incorporated herein by reference.

Figure 5:
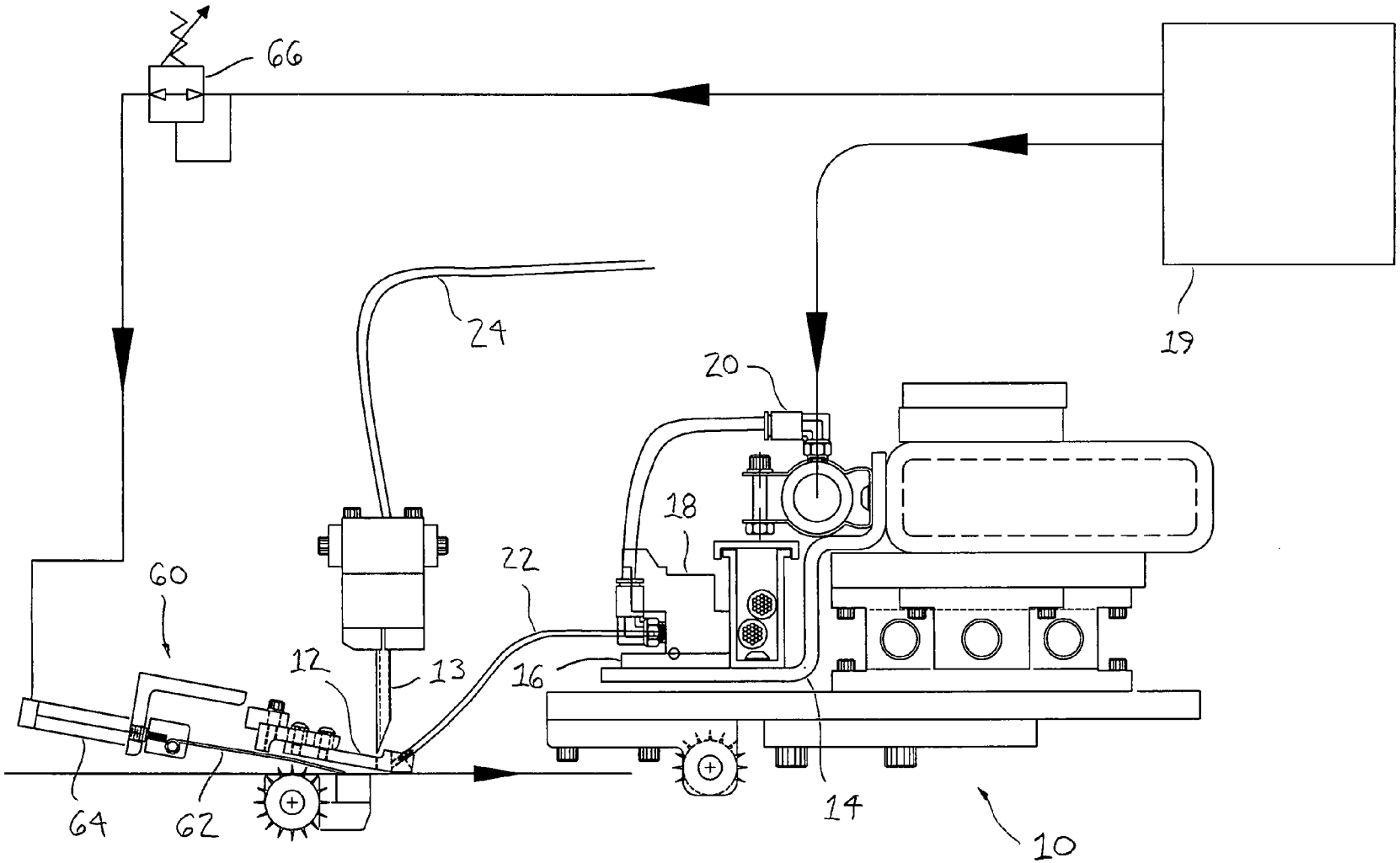
FIG. 5 is a left side view of the preferred digital presser foot injector illustrated in FIG. 1 and the preferred stitch retractor assembly with the yarn applicator and the stitch retractor assembly in a retracted position in accordance with the present invention.

Referring now to FIG. 5, a left side view of the preferred digital presser foot injector illustrated in FIG. 1 and the preferred stitch retractor assembly with the yarn applicator and the stitch retractor assembly in a retracted position is illustrated. As shown in FIG. 5, preferred digital presser foot injector 10 is adapted to convey air to presser foot 12 when yarn applicator 13 is penetrating the backing of a surface covering. The preferred digital presser foot injector 10 is mounted on mounting bracket 14 and mounting bar 16 and includes at least one solenoid valve 18. Preferred compressor 19 provides air to the system. Preferably, digital presser foot injector 10 conveys air to presser foot 12 via a means for conveying air such as air manifold 20 and presser foot line 22.

Figure 6:
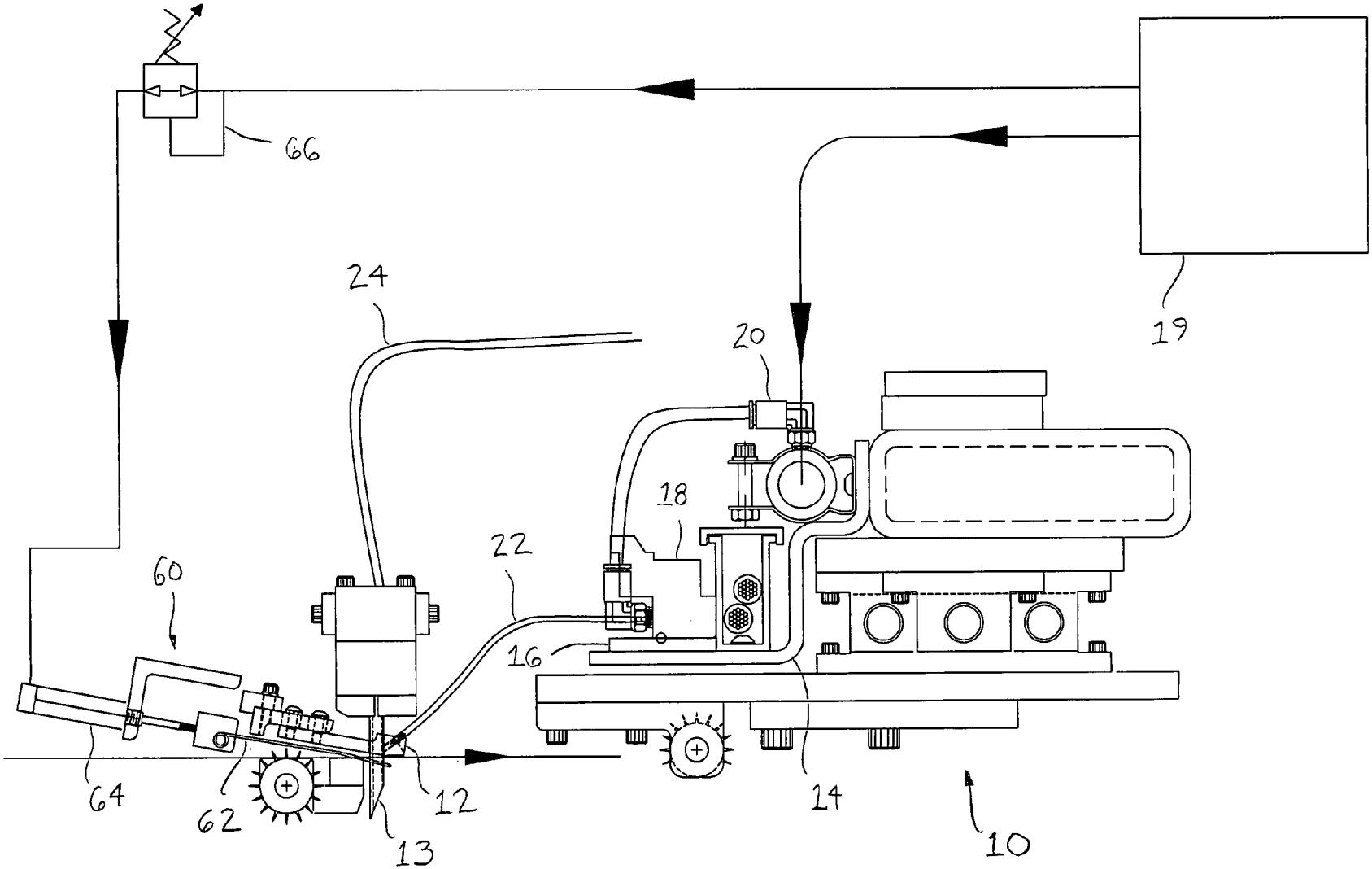
FIG. 6 is a left side view of the preferred digital presser foot injector illustrated in FIGS. 1 and 5 and the preferred stitch retractor assembly illustrated in FIG. 5 with the yarn applicator and the stitch retractor assembly in an extended position in accordance with the present invention.

Still referring to FIG. 5, the preferred system also includes stitch retractor assembly 60. The preferred stitch retractor assembly 60 is adapted to pull out or remove a stitch from the backing of a surface covering. More particularly, preferred stitch retractor assembly 60 is adapted to pull the cut stitches that result when a color change takes place on a loop surface covering from the face of the backing to the back of the backing. The preferred stitch retractor assembly 60 produces loop surface coverings with only loop stitches and no cut stitches on the face of the backing. The preferred stitch retractor assembly comprises wire 62 which is adapted to be moved between a retracted position as illustrated in FIG. 5 and an extended position as illustrated in FIG. 6. The preferred wire 62 is moved between a retracted position and an extended position by air cylinder 64. The preferred air cylinder is a single acting, spring return air cylinder, but it is contemplated within the scope of the invention that any suitable device, mechanism, assembly or combination thereof may be used to move the wire between a retracted position and an extended position. Preferably, compressor 19 provides air to stitch retractor assembly 60. It is contemplated within the scope of the invention, however, that any suitable device, mechanism, assembly or combination thereof may be used to provide air the stitch retractor assembly. The movement of the preferred stitch retractor assembly 60 is preferably controlled by one or more three-way solenoid valves 66, but it is contemplated within the scope of the invention that any suitable device, mechanism, assembly or combination thereof may be used to control the movement of the assembly. When in the retracted position, the preferred stitch retractor assembly 60 does not interfere with the operation of yarn applicator 13.

Referring now to FIG. 6, a left side view of the preferred digital presser foot injector illustrated in FIGS. 1 and 5 and the preferred stitch retractor assembly illustrated in FIG. 5 is illustrated with yarn applicator 13 and stitch retractor assembly 60 in an extended position. When yarn applicator 13 is in an extended position, it is adapted to penetrate the backing of a surface covering. When stitch retractor assembly 60 is in an extended position, it is adapted to pull cut stitches from the face of the surface covering backing to the back of the backing so that only loop stitches are present on the face of the surface covering. Indeed, when the preferred stitch retractor assembly 60 is moved from the extended position to the retracted position, the cut stitches on the face of the surface covering are pulled from the face of the backing through the backing to the back of the surface covering backing, thereby leaving only loop stitches on the face of the surface covering.

Figure 7:
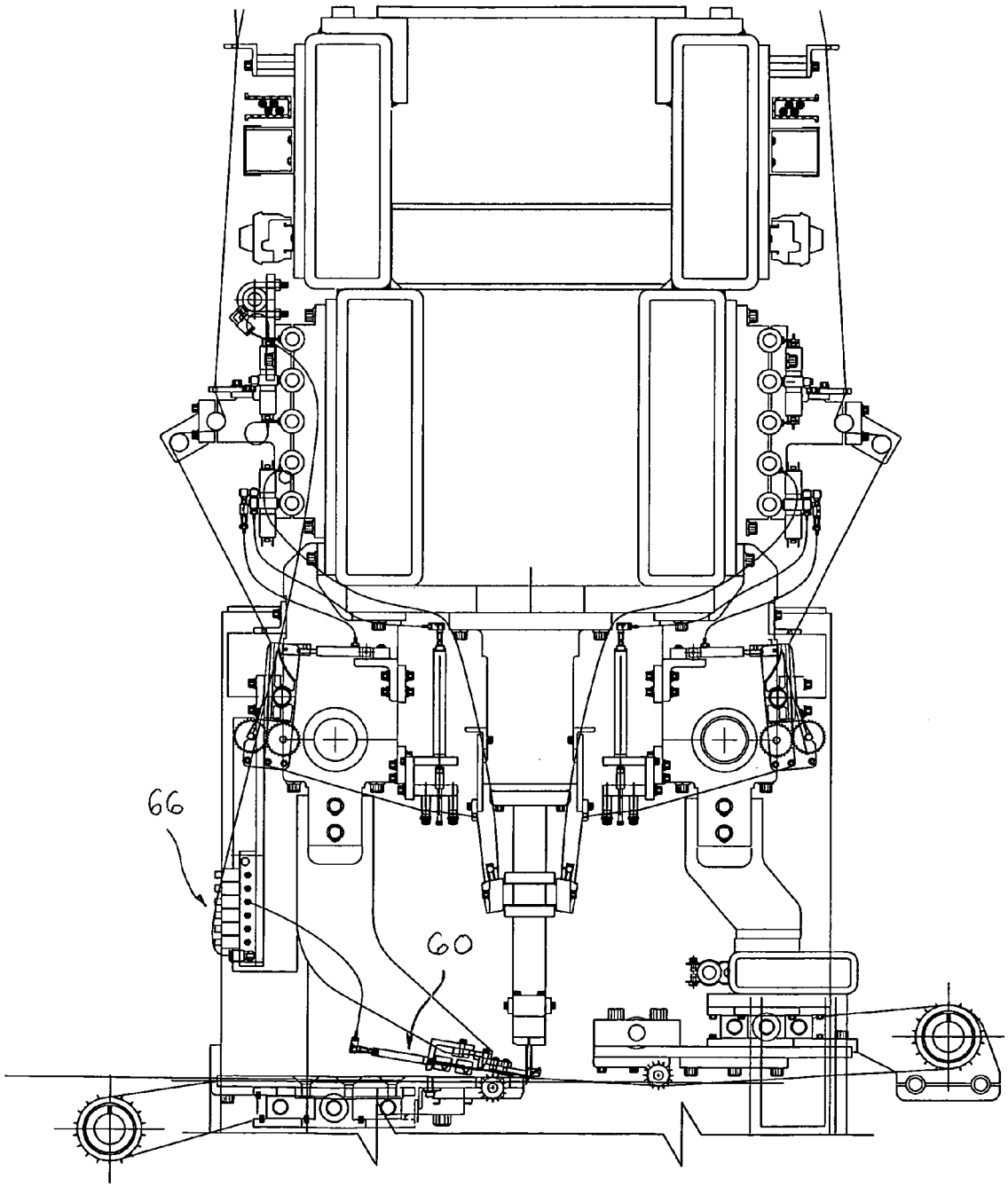
FIG. 7 is a left side view of an exemplary tufting machine including the preferred stitch retractor assembly illustrated in FIGS. 5-6 in accordance with the present invention.

Referring now to FIG. 7, a left side view of an exemplary tufting machine including the preferred stitch retractor assembly 60 is illustrated. As shown in FIG. 7, the exemplary tufting machine includes preferred stitch retractor assembly 60 and solenoid valves 66. The preferred stitch retractor assembly 60 is adapted to receive compressed air only when it is being moved between a retracted position and an extended position. While the preferred stitch retractor assembly 60 is adapted for use on a tufting machine including the preferred compressed air system described and illustrated herein, it is contemplated within the scope of the invention that the preferred stitch retractor assembly 60 may by adapted for use on a tufting machine that does not include the compressed air system described and illustrated herein. It is further contemplated that the preferred stitch retractor assembly 60 described and claimed herein may be adapted for use with a tufting machine controlled by a control system different from the control system described and illustrated herein.

Referring now to FIG. 8, a left side view of the preferred stitch retractor assembly wire 62 is illustrated. As shown in FIG. 8, the preferred stitch retractor assembly wire is attached to air cylinder 64 at spiral 68 and distal end 70 is bent slightly downward. As shown in FIG. 8A, the preferred wire 62 is generally shaped like an open-ended oval or loop with the distal end being closed. The preferred distal end 70 is adapted to pull cut stitches from the face of the surface covering backing to the back of the backing. While FIGS. 8 and 8A illustrate the preferred configuration of wire 62, it is contemplated within the scope of the invention that the wire may be of any suitable configuration adapted to pull cut stitches from the face of the surface covering backing to the back of the backing.

Figure 9:
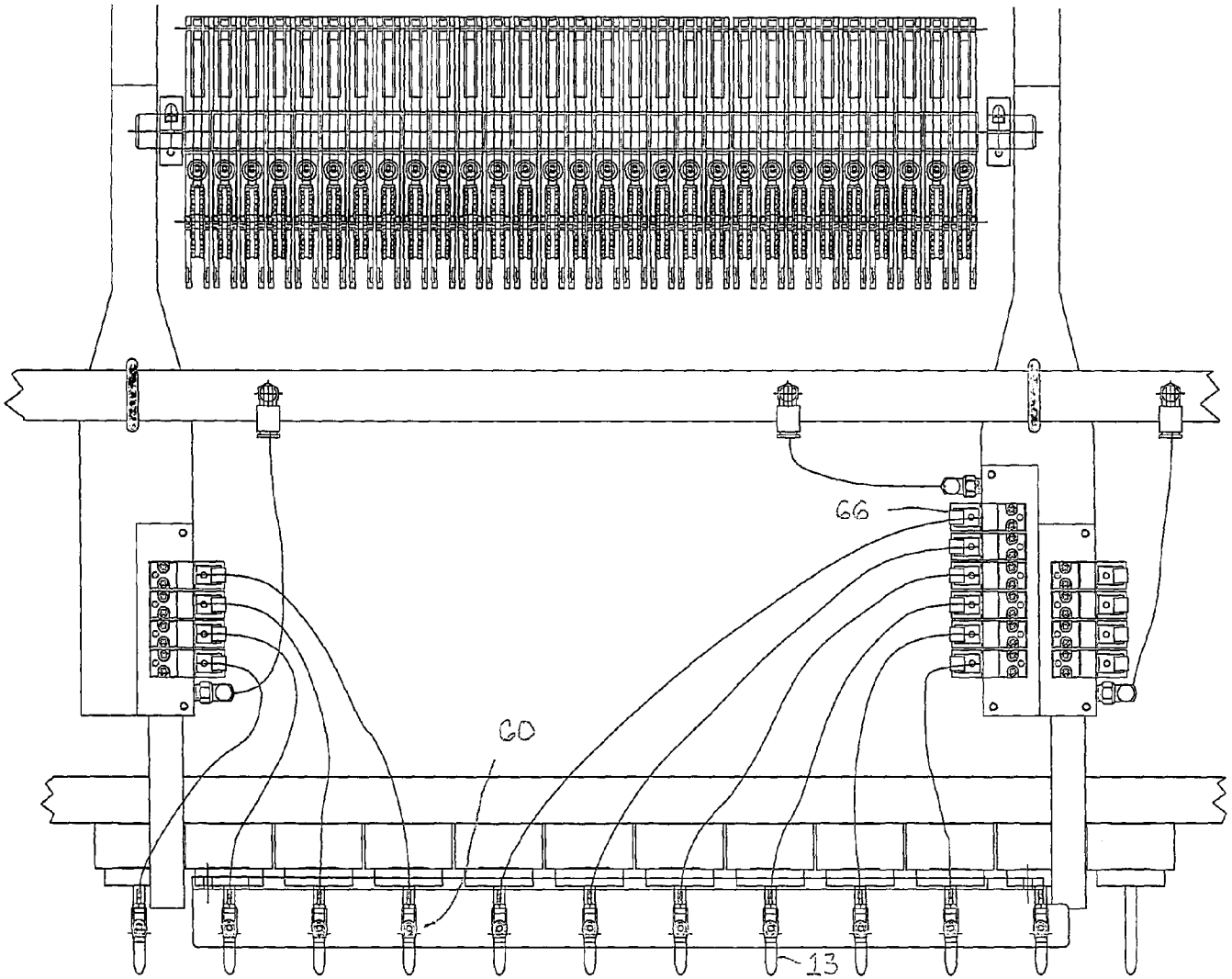
FIG. 9 is a front view of an exemplary tufting machine including the preferred stitch retractor assembly illustrated in FIGS. 5-8A in accordance with the present invention.

Referring now to FIG. 9, a front view of an exemplary tufting machine including the preferred stitch retractor assembly 60 is illustrated. As shown in FIG. 9, the movement of the preferred stitch retractor assemblies 60 and the preferred plurality of yarn applicators 13 are controlled by three-way solenoid valves 66.

The invention also comprises a method for controlling compressed air in a tufting machine. The preferred embodiments of the method for controlling compressed air in a tufting machine comprises providing a compressed air system as described herein. In addition, the preferred method for controlling compressed air in a tufting machine comprises controlling the digital presser foot injector so as to convey air to the presser foot when the yarn applicator is penetrating the backing of a surface covering. The preferred method for controlling compressed air in a tufting machine further comprises controlling the funnel block injector so as to convey air to the funnel block while the yarn applicator is placing a stitch in the backing of a surface covering.

In operation, the preferred embodiments of the apparatus and method for a compressed air system achieve several advantages. For example, the preferred embodiments of the invention reduce the amount of compressed air used by a tufting machine. More particularly, the preferred embodiments of the compressed air system are adapted to convey compressed air to the digital presser foot injector and the funnel block injector only when the yarn applicator is in use, i.e. only when the yarn applicator is penetrating the backing of a surface covering or placing a stitch in the backing of a surface covering. In addition, the preferred embodiments of the invention reduce the cost of operating a tufting machine.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents.

What is claimed is:

1. A compressed air system adapted for use in connection with a tufting machine having a yarn applicator adapted to penetrate a backing of a surface covering and place a stitch in the backing of the surface covering, a presser foot and a funnel block, said compressed air system comprising:

(a) an air source, said air source being adapted to provide air to the compressed air system;

(b) a digital presser foot injector, said digital presser foot injector being adapted to convey compressed air to the presser foot;

(c) a funnel block injector, said funnel block injector being adapted to convey compressed air to the funnel block;

wherein said compressed air system is adapted to convey compressed air to the presser foot of the digital presser foot injector and the funnel block of the funnel block injector only when the yarn applicator is in use.

2. The compressed air system of claim 1 wherein said compressed air system is adapted to convey compressed air to the presser foot only when the yarn applicator is penetrating the backing of the surface covering, and wherein said compressed air system is adapted to convey compressed air to the funnel block only when the yarn applicator is placing the stitch in the backing of the surface covering.

3. The compressed air system of claim 1 wherein the said compressed air system comprises a plurality of yarn applicators, a plurality of digital presser foot injectors and a plurality of funnel block injectors, and wherein each of the plurality of yarn applicators is operatively connected to one of the plurality of digital presser foot injectors and one of the plurality of funnel block injectors.

4. The compressed air system of claim 3 wherein said compressed air system is adapted to convey compressed air to only the digital presser foot injectors and the funnel block injectors that are operatively connected to a yarn applicator that is penetrating the backing of the surface covering or placing the stitch in the backing of the surface covering.

5. The compressed air system of claim 1 wherein the air source is a compressor.

6. The compressed air system of claim 1 wherein the digital presser foot injector comprises a means for controlling the conveyance of compressed air.

7. The compressed air system of claim 5 wherein the means for controlling the conveyance of compressed air is a solenoid valve.

8. The compressed air system of claim 1 wherein the digital presser foot injector comprises a means for conveying compressed air to the presser foot.

9. The compressed air system of claim 1 wherein the funnel block injector comprises a means for controlling the conveyance of compressed air to the funnel block.

10. The compressed air system of claim 8 wherein the means for controlling the conveyance of compressed air to the funnel block is a solenoid valve.

11. The compressed air system of claim 1 wherein the funnel block injector comprises a means for conveying compressed air to the funnel block.

12. The compressed air system of claim 1 wherein the digital presser foot injector and the funnel block injector receive a signal from a motion controller.

13. The compressed air system of claim 1 wherein the tufting machine further comprises a stitch retractor assembly, said stitch retractor assembly being adapted to pull a stitch from a face of the backing of the surface covering to a back of the backing of the surface covering.

14. The compressed air system of claim 13 wherein a cut-loop software program controls the digital presser foot injector, the funnel block injector and the stitch retractor assembly.

15. The compressed air system of claim 13 wherein a hardware solution controls the digital presser foot injector, the funnel block injector.

16. The compressed air system of claim 15 wherein the hardware solution comprises a logic gate device.

17. The compressed air system of claim 1 wherein said compressed air system is controlled by a remote process control computer system.

18. A compressed air system adapted for use in a tufting machine having a plurality of yarn applicators each of which is adapted to penetrate a backing of a surface covering and place a stitch in the backing of the surface covering, a plurality of presser feet and a plurality of funnel blocks, said compressed air system comprising:

(a) an air source, said air source being adapted to provide compressed air to the compressed air system;

(b) a plurality of digital presser foot injectors, said plurality of digital presser foot injectors being adapted to convey compressed air to one of the plurality of presser feet;

(c) a plurality of funnel block injectors, said plurality of funnel block injectors being adapted to convey compressed air to one of the plurality of funnel blocks;

wherein said compressed air system is adapted to convey compressed air to each of the plurality of presser feet only when the yarn applicator with which said presser foot is operatively connected is penetrating the backing of the surface covering, and wherein said compressed air system is adapted to convey compressed air to each of the plurality of funnel blocks only when the yarn applicator with which said funnel block is operatively connected is placing the stitch in the backing of the surface covering.

19. A method for controlling compressed air in a tufting machine having a yarn applicator adapted to penetrate a backing of a surface covering, a presser foot and a funnel block, said method comprising:

(a) providing a compressed air system, said compressed air system comprising:

(1) an air source, said air source being adapted to provide air to the compressed air system;

(2) a digital presser foot injector, said digital presser foot injector being adapted to convey air to the presser foot;

(3) a funnel block injector, said funnel block injector being adapted to convey air to the funnel block;

wherein the compressed air system is adapted to convey air to the presser foot and funnel block only when the yarn applicator is in use;

(b) conveying air to the presser foot only when the yarn applicator is in use; and, (c) conveying air to the funnel block only when the yarn applicator is in use.

20. The method for controlling compressed air in a tufting machine of claim 19 further comprising:

(d) conveying air to the presser foot only when the yarn applicator is penetrating the backing of the surface covering; and, (e) conveying air to the funnel block only when the yarn applicator is placing a stitch in the backing of the surface covering.

* * * * *